United States Patent [19]

Tiku et al.

[11] Patent Number: 4,482,841

[45] Date of Patent: Nov. 13, 1984

[54] COMPOSITE DIELECTRICS FOR LOW VOLTAGE ELECTROLUMINESCENT DISPLAYS

[75] Inventors: Shiban K. Tiku; Milo R. Johnson, both of Richardson, Tex.

[73] Assignee: Texas Instruments Incorporated, Dallas, Tex.

[21] Appl. No.: 353,991

[22] Filed: Mar. 2, 1982

[51] Int. Cl.[3] ..... H01J 1/70

[52] U.S. Cl. ..... 313/503; 313/509; 313/506; 313/512

[58] Field of Search ..... 313/503, 506, 509, 512; 427/126.4

[56] References Cited

U.S. PATENT DOCUMENTS 3,073,982 1/1963 Buck, Jr. et al. ..... 313/509
4,416,933 11/1983 Antson et al. ..... 313/509 X

FOREIGN PATENT DOCUMENTS 2810524 9/1978 Fed. Rep. of Germany ..... 313/509

OTHER PUBLICATIONS

Marrello et al., "Direct Current Thin Film Electroluminescence Device", IBM Technical Disclosure Bulletin, vol. 22, No. 4, p. 1636, Sep. 1979.

Miura et al., "Thin Film AC $ZnS_xSe_{1-x}$:Mn EL", IEEE Conference International Electron Devices Meeting, Tech. Dig. Wash, D.C., Dec. 1980, pp. 715–718.

*Primary Examiner*—Eugene R. LaRoche
*Assistant Examiner*—Vincent De Luca
*Attorney, Agent, or Firm*—Robert Groover; James T. Comfort; Melvin Sharp

[57] ABSTRACT

The dielectric, which is provided on either side of the active phosphor in an AC-driven electroluminescent display, is formed of a composite material which has both high dielectric constant and high resistivity. Preferably, a composite of titanum dioxide and alumina is used.

11 Claims, 2 Drawing Figures

COMPOSITE DIELECTRICS FOR LOW VOLTAGE ELECTROLUMINESCENT DISPLAYS

BACKGROUND OF THE INVENTION

The present invention relates to thin film electroluminescent displays.

The configuration of a thin film electroluminescent display according to the prior art is generally shown in FIG. 1. An electroluminescent phosphor 10 is sandwiched between two dielectric layers 12. A transparent conductor 14 and a back electrode 16 are used to address the display.

A pre-eminent difficulty in the commercial application of thin film electroluminescent displays has been the high voltages which are required. Since electroluminescence is produced in the phosphor 10 only at an electric field strength of about a megavolt per centimeter or more, the drive voltages which must be applied are quite high. Typically, the drive voltages required in a thin film electroluminescent display according to the prior art will be substantially higher than those used in plasma display panels, and may be as high as 200 volts or more. Such high display address voltages mean that the display driver circuits required are very expensive and physically large. However, since the dielectric layers 12 have a finite dielectric constant, not all of the AC voltage which is applied to the conductors 14 and 16 appears across the phosphor 10. Thus, significant portions of the large applied voltages are not strictly required to achieve the desired electroluminescence.

A further possible source of voltage inefficiency is caused by the finite resistivity of the dielectric layers 12. The ohmic current which flows vertically in the dielectric layers 12 imposes a further burden on the display drivers, and, if the dielectric loss of the dielectric layers 12 is high enough, further voltage inefficiency is caused.

The joint constraint of these two problems is difficult to satisfy. For example, if titanium dioxide were used for the dielectric, its very high dielectric constant (above 100) would mean that nearly all the applied voltage would appear across the phosphor. However, it is difficult to deposit titanium dioxide films with a resistivity of much more than 108 ohm cm, and such a low resistivity would cause dielectric loss which would more than offset the advantage obtained through the high dielectric constant of titanium dioxide. Conversely, dielectrics such as alumina or silicon nitride have adequately high resistivity, but have relatively low dielectric constants (less than 10), so that much of the applied voltage appears across the dielectric layers 12 rather than across the phosphor 10.

Ferroelectric materials such as barium or lead titanate have high dielectric constants. However, it is very difficult to deposit thin films of these materials by evaporation as the melting points of the component oxides (i.e., in the case of barium titanate, barium oxide, and titanium dioxide) are widely different. In order to achieve the perovskite phase, which is essential for achieving high dielectric constant, the substrate temperature must be higher than 550 degrees C. Thus the process can not be used on ordinary glass. Moreover these materials have high loss and low dielectric strength.

Thus, it is an object of the present invention to provide a material for the dielectric layers of thin film electroluminescent display devices which has both a very high resistivity and a very high dielectric constant.

It is a further object of the present invention to provide electroluminescent display devices requiring only a minimal applied voltage.

It is a further object of the present invention to provide electroluminescent display devices having a large ohmic resistance and a large capacitance in series with the active phosphor of each pixel.

It is a further object of the present invention to provide a method for fabricating thin film electroluminescent displays having good voltage efficiency.

Further references regarding TFEL displays, all of which are hereby incorporated by reference, include *Electroluminescence* (ed. J. Pankove, 1977); Hurd & King, Physical and Electrical Characterization of Co-Deposited ZnS:Mn Electroluminescent Thin Film Structures, 8 J. Electronic Materials 879 (1979); Tanaka et al, Evidence for the Direct Impact Excitation of Mn Centers in Electroluminescent ZnS:Mn Films, 47 J. Applied Physics 5391 (1976); Krupka, Hot-Electron Impact Excitation of Tb+++Luminescence in ZnS:Tb+++Thin Films, 43 J. Applied Physics 476 (1972).

Titanium dioxide has an excessive dielectric loss. Some typical values for the dissipation factor (which measures dielectric lossiness) are for alumina, 0.001 or less; for titanium dioxide, around 0.01, for ZnS, around 0.005. (Since these values are heavily dependent on process parameters, they should be regarded only as rough indicators.) If the dielectric has a dissipation factor much greater than that of the phosphor, substantial thermal dissipation in the dielectric will result. Thus, a desired objection is a dissipation factor of 0.005 or less, with a dielectric constant of 30 or better.

SUMMARY OF THE INVENTION

The present invention forms the dielectric layers of the thin film electroluminescent display from a composite material comprising a mixture of a first dielectric material selected for high resistivity and a second dielectric material selected for a high dielectric constant. For example, a composite mixture of alumina and titanium dioxide may be used.

According to the present invention, there is provided:

A thin film electroluminescent display, comprising:

an active phosphor layer;

first and second dielectric layers, adjacent to said phosphor layer and on opposite sides thereof; and first and second conductor layers respectively adjacent to said first and second dielectric layers and not in contact with said phosphor layer;

wherein said dielectric layers each comprise a uniform mixture of a first dielectric material and a second dielectric material, said first dielectric material having a dielectric constant which is substantially higher than the dielectric constant of said phosphor, and said second dielectric material having a low dielectric loss.

BRIEF DESCRIPTION OF THE DRAWING

The present invention will be described with reference to the accompanying drawings, wherein.

DESCRIPTION OF THE PREFERRED EMBODIMENTS

Figure 1:
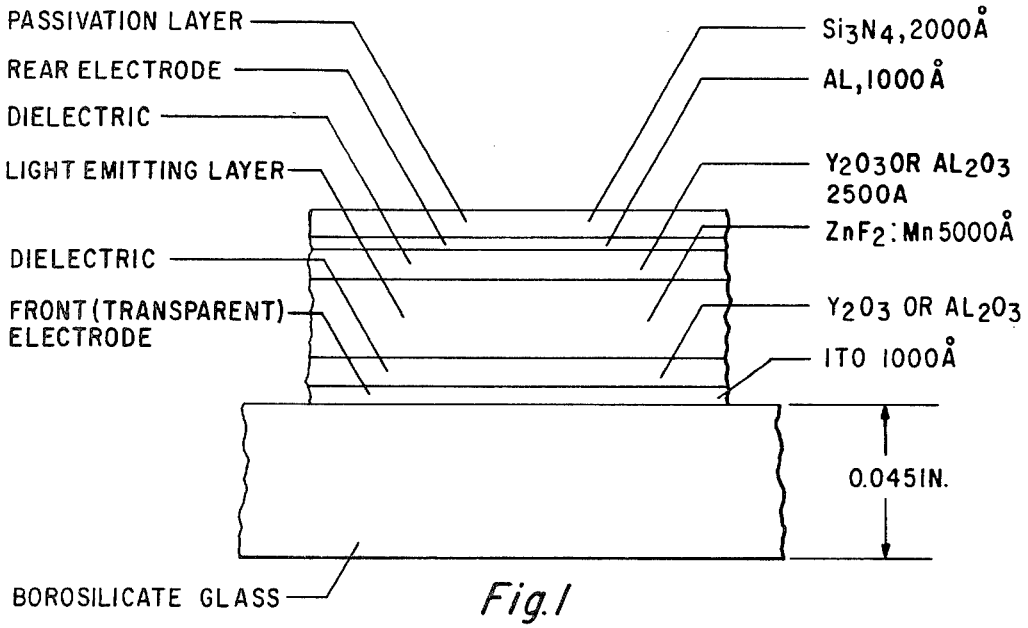
FIG. 1 shows a thin-film electroluminescent device fabricated by the process of the present invention.
Figure 2:
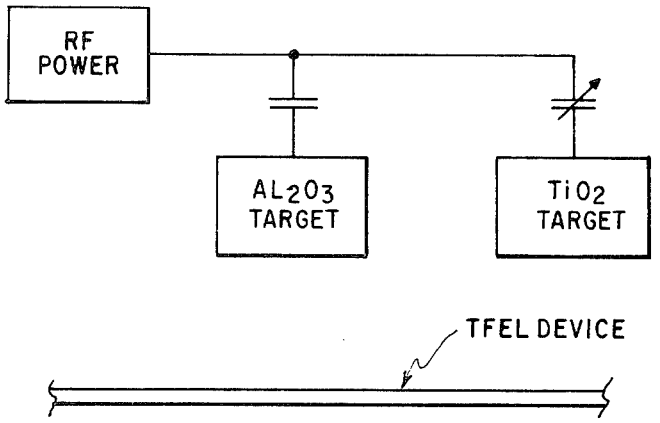
FIG. 2 shows generally a system for co-sputtering of alumina and titanium dioxide.

The present invention will be described with a primary reference to a thin film electroluminescent display wherein the active phosphor layer is zinc sulfide doped with manganese. However, the present invention may also be provided to other dopants or other phosphor materials, since it applies generally to any thin film electroluminescent display.

As discussed above, an electric field of the order of 106 volts per centimeter is normally required for thin film electroluminescent (TFEL) displays. This large electric field requirement necessitates substantial voltages to be carried on the electodes 14 and 16. However, not all of the applied voltage $V_{app}$ is useful in the production of light. The ratio of the voltage $V_{phos}$ which actually appears across the active phosphor layer, to the voltage which $V_{diel}$ merely appears across the dielectric layers 12, is equal to the ratio of the dielectric constant of the phosphor to the dielectric constant of the dielectric layers 12, times the ratio of the thickness of the phosphor to the total thickness of the two dielectric layers. That is, $$V_{app} = V_{phos}\,1 + \frac{2\,E_{phos}\,D_{diel}}{E_{diel}\,D_{phos}}$$

where $D_{phos}$ equals thickness of the phosphor layers, $E_{phos}$ equals dielectric constant of the phosphor layer, $D_{diel}$ equals thickness of each dielectric layer 12, and $E_{diel}$ equals dielectric constant of the dielectric layer material.

For example, where the display is constructed with a ZnS phosphor which is 300 nm thick, and a dielectric layer 12 which is 200 nm thick and has a dielectric constant of 50, $$\frac{V_{phos}}{V_{diel}} = \frac{0.3 \times 50}{2 \times 0.2 \times 6.0} = 6.25$$

Thus, $$V_{app} \text{ equals } V_{phos}\left(1 + \frac{1}{6.25}\right).$$

Since the critical field for light emission in ZnS:Mn is approximately a megavolt per cm, the minimum V for an active pixel, in the above example, is 30 volts, and the minimum applied voltage is therefore approximately 35 volts. Note that if the dielectric constant of the dielectric layers had been smaller than 50, the required applied voltage would be much higher. For example, if the dielectric layers had a dielectric constant of 6, with the same layer thicknesses, the requisite applied voltage would be 70 volts. More realistically, if a 500 nm thick phosphor is used to attain greater on-state brightness, the required applied voltage would be either at least 90 volts if the dielectric layer 12 has a dielectric constant no lower than that of the active phosphor layer, but no more than 70 volts if the dielectric constant of the dielectric layers 12 is at least twice that of the phosphor layer.

As noted above, it is highly desirable to minimize the required operating voltages. In particular, a cost threshold is attained at about 70 volts, since conventional bipolar designs can be used (with vastly reduced costs) below these voltages. At higher operating voltages, high voltage MOS output stages are necessary, and are expensive.

A further constraint on the choice of dielectric is the dielectric strength. Particularly where the dielectric layer 12 has a low dielectric constant, this may be relevant. For example, if the dielectric layer 12 has a lower dielectric constant than that of the active phosphor layer, then the electric field applied to the dielectric material will be greater than the field strength in the phosphor. With some materials, catastrophic breakdown may become a problem. However, with high-dielectric-constant materials this is typically not a problem.

The other major limitation on the choice of material for the dielectric layers 12 is, as mentioned above, dielectric loss.

To attain a high dielectric constant for the dielectric layers 12, $TiO_2$ (which has a dielectric constant above 100) could be used. However, $TiO_2$ has an unacceptablly high dielectric loss, due to its defect structure. This results in resistive current flowing in the dielectric layer, at voltages lower than the turn-on voltage the active phosphor.

$TiO_2$, whether evaporated or produced by thermal oxidation of Ti, has a tendency to non-stoichiometry resulting in dielectric loss and optical absorbtion.

The optimal trade-off between dielectric constant and dielectric loss is at a dielectric constant of about 20. However, a very broad range of other compositions, leading to other dielectric constants, are also taught by the present invention.

Where titanium dioxide is dispersed in a good dielectric matrix, particularly where the matrix is amorphous, a high resistivity and breakdown strength, together with a high dielectric constant, result.

An amorphous alumina substrate is capable of providing an excellent surface for ZnS to grow on. With 20% titanium dioxide admixture, the composite dielectric constant of the material is raised to about 20.

Mixtures of alumina and phosphorous pentoxide, and of alumina and silicon dioxide have been used in silicon processing, to obtain better passivation properties. However, these films were constructed to meet requirements quite different from those indicated by the TFEL art.

Reduction of the thickness of the dielectric layers 12 to less than 200 nm is not at present practical, since such thin films are at present unreliable due to pin hole problems. Thus, use of material with a higher dielectric constant is at present the only apparently practical way to reduce the voltage drop across the dielectric layers.

Optionally, a final annealing step may be used to further assure stability of the dielectric layer. For example, a possible annealing step is 500 degrees for 60 minutes in argon, nitrogen, or vacuum.

The present invention provides composite dielectric material for the dielectric layers 12, which has both high dielectric constant and low dielectric loss. Preferably a uniform mixture of $Al_2O_3$ and $TiO_2$ is used. This composite provides a low dielectric loss and a high dielectric constant. By varying the ratio of $Al_2O_3$ to $TiO_2$, by the method described below, different trade-offs between high dielectric constant and low dielectric loss are selectable.

Additionally, the dielectric layer 12 used for TFEL device should have a low optical absorbtion in a 200 nm film. Further, the dielectric should have a high refractive index (since the refractive index of ZnS is 2.49), to minimize reflection at the phosphor/dielectric interface. Moreover, the dielectric should be mechanically and chemically stable. An admixture of $TiO_2$ assist in meeting all of these conditions.

To deposit the composite dielectric film, a mixture of titanium dioxide and aluminia is co-evaporated or co-sputtered. For example, in reactive sputtering, separate targets of aluminum and titanium are simultaneously sputtered (in an oxygen atmosphere) to attain a uniform selected composition, by independently controlling the power applied to each of two separate targets. Another way is to sputter simultaneously from two targets of titanium dioxide and alumina, similarly using independent rate control on the two targets. This is easily done in r. f. sputtering where the output of a single generator is split between the two targets by using capacitors.

Alternatively, a pellet containing a mixture of $Al_2O_3$ and $TiO_2$ is used for E-beam evaporation. Since the melting points of $TiO_2$ and $Al_2O_3$ are not very different, the relative rates of evaporation are well controlled by the initial composition of the pellet. Oxygen (around 10–4 fraction) is used to assure stoicheometry during the evaporation process.

In alternative embodiments, the fraction of titanium dioxide (or other high-permittivity material) is varied between 1% and 49%.

What I claim is:

1. A thin film electroluminescent display, comprising:

an active phosphor layer;

first and second dielectric layers, adjacent to said phosphor layer and on opposite sides thereof;

first and second conductor layers respectively adjacent to said first and second dielectric layers and not in contact with said phosphor layer;

a substrate adjacent to said first conductor layer; and an encapsulation layer adjacent to said second conductor layer;

wherein at least one of said dielectric layers consists essentially of a uniform mixture of a first dielectric material and a second dielectric material, said first dielectric material having a dielectric constant which is more than twice the dielectric constant of said phosphor, and said second dielectric material having a dielectric loss less than said phosphor.

2. The display of claim 1, wherein said second dielectric material also has good transparency.

3. The display of claim 1, wherein said first dielectric material is selected from the group consisting of titanium oxide, zirconium oxide, and hafnium oxide.

4. The display of claim 1, wherein said second dielectric material is selected from the group consisting of aluminum oxide, scandium oxide, and yttrium oxide.

5. The display of claim 1, 3, or 4, wherein the fraction of said first dielectric material in said mixture is between 1% and 49%.

6. The display of claim 5, wherein said first dielectric material is titanium dioxide.

7. The display of claim 4, wherein said second dielectric material comprises alumina.

8. The display of claim 7, wherein said first dielectric material comprises titanium dioxide.

9. The display of claim 7, wherein said uniform mixture comprises approximately 80% of alumina.

10. The display of claim 1, wherein said phosphor comprises ZnS, and said composite dielectric material has a dielectric constant of approximately 20.

11. The display of claim 1, wherein one of said conductor layers comprises indium tin oxide.

* * * * *